US006805420B2

(12) United States Patent
Sumi

(10) Patent No.: US 6,805,420 B2
(45) Date of Patent: Oct. 19, 2004

(54) DRIVE UNIT FOR LIQUID EJECTION HEAD AND LIQUID EJECTION APPARATUS PROVIDED WITH SUCH UNIT

(75) Inventor: Koji Sumi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/094,429

(22) Filed: Mar. 8, 2002

(65) Prior Publication Data

US 2002/0149638 A1 Oct. 17, 2002

(30) Foreign Application Priority Data

Mar. 9, 2001 (JP) ..... 2001-067526
Mar. 5, 2002 (JP) ..... 2002-058636

(51) Int. Cl.[7] ..... B41J 29/38
(52) U.S. Cl. ..... 347/10; 347/11; 347/68
(58) Field of Search ..... 347/10, 11, 68, 347/9

(56) References Cited

U.S. PATENT DOCUMENTS 5,818,472 A * 10/1998 Usui et al. ..... 347/10
6,193,360 B1 * 2/2001 Nishiwaki et al. ..... 347/70
6,273,538 B1 * 8/2001 Mitsuhashi et al. ..... 347/11
6,318,829 B1 * 11/2001 Suzuki ..... 347/11
6,464,315 B1 * 10/2002 Otokita et al. ..... 347/9
2002/0005873 A1 * 1/2002 Suzuki ..... 347/27
2002/0057303 A1 * 5/2002 Takahashi et al. ..... 347/9

FOREIGN PATENT DOCUMENTS

| | | |
|---|---|---|
| JP | 6-340075 | 12/1934 |
| JP | 9-226106 | 9/1997 |
| JP | 10-24570 | 1/1998 |

* cited by examiner

*Primary Examiner*—Hai Pham
*Assistant Examiner*—Lam Nguyen
(74) *Attorney, Agent, or Firm*—Sughrue Mion, PLLC

(57) ABSTRACT

In a drive unit and a drive method for liquid ejection head, a voltage applied to a piezoelectric thin film has an electric potential stable period in the course of returning from an electric potential, when pressure chamber has contracted for the ejection of liquid, such as ink, to another electric potential prior to a drive for the next ejection. Intermittently disconnecting a circuit during residual vibration of meniscus suppresses changes of the electric potential. Deformation of the piezoelectric thin film and vibrations of the diaphragm are also suppressed. Compliance of the diaphragm and the natural vibration period Tc of pressure chambers are decreased. A significant effect can be obtained when using a piezoelectric thin film. Thus, a liquid ejection head drive unit and drive method are provided which effectively suppress the vibration of meniscus with a simple configuration and apparatus. The diaphragm can be sufficiently deflected during liquid ejection and the residual vibrations can be rapidly attenuated after the ejection.

7 Claims, 4 Drawing Sheets

1: INK-JET RECORDING HEAD

DRIVE UNIT FOR LIQUID EJECTION HEAD AND LIQUID EJECTION APPARATUS PROVIDED WITH SUCH UNIT

BACKGROUND OF THE INVENTION

1. Field of the Invention

The present invention relates to a drive unit for a liquid ejection head for ejecting a liquid such as ink and the like by controlling a voltage applied to piezoelectric elements. In particular, the present invention relates to a drive unit which enhances the attenuation of meniscus vibrations. Further, the present invention also relates to a liquid ejection apparatus such as a printer which is equipped with such a drive unit, and to a drive method for a liquid ejection head.

2. Description of the Related Art

Ink-jet recording heads of an on-demand type comprise pressure chambers in which ink pressure is generated by piezoelectric elements or heat-generating elements, ink chambers supplying the ink into the pressure chambers, and nozzles ejecting the ink from the pressure chambers. Pressure is generated by applying drive signals to the elements corresponding to the printing signals, and ink droplets are ejected from the nozzles onto the recording medium. In particular, the advantage of the ink-jet recording heads using piezoelectric elements over the ink-jet recording heads of other types is that because no heat is used, the degradation of ink and clogging are prevented.

However, after the pressure was generated inside the pressure chamber and ink has been ejected, pressure fluctuations remain in the pressure chamber. As a result, the meniscus located inside the nozzle recovers to the nozzle tip, while vibrating at a resonance frequency inherent to the pressure chamber. However, it recently became necessary to drive the printing at a high frequency in order to conduct fine printing at a high speed. Because of such a necessity, if the next ejection is started while the residual fluctuations are not fully suppressed, the meniscus is not stabilized. For this reason, there is a spread in the amount of ejected ink and in the direction of droplet, which causes degradation of printing quality.

Japanese Patent Laid-open Publication No. 9-226106 discloses a process of applying, as shown in FIG. 6, a first signal, which causes the expansion of a pressure chamber, with a period shorter than the period Tc determined by the Helmholtz resonance frequency of the pressure chamber, and a second signal, which maintains the expanded state of the pressure chamber, at no more than ½ of Tc. As a result, the initial vibrations of the meniscus can be decreased and the meniscus vibrations can be rapidly attenuated.

Furthermore, Japanese Patent Laid-open Publication No. 10-24570 discloses a process of outputting, as shown in FIG. 7, a first signal causing the expansion of a pressure chamber, a second pulse causing the contract of the pressure chamber that assumed an expanded state and the ejection of an ink droplet from a nozzle, and a third pulse again expanding the pressure chamber. The vibrations of meniscus are attenuated by detecting the ambient temperature and controlling the initiation timing of the pulses.

Further, Japanese Patent Laid-open Publication No. 6-340075 discloses a process of temporarily terminating charging or discharging of piezoelectric elements by matching the timing and natural frequency of piezoelectric elements. As a result, the attenuated vibrations of piezoelectric elements are decreased.

Japanese Patent Laid-open Publication No. 9-226106 decreases the initial vibration of meniscus to shorten the attenuation period, however, the residual vibrations of meniscus cannot be effectively suppressed.

Furthermore, in Japanese Patent Laid-open Publication No. 10-24570, a control based on the results of detecting the ambient temperature is necessary to match the vibration timing of meniscus and the apparatus inevitably becomes complex.

Vibrations of meniscus have been thought to be mainly dependent on properties (viscosity and the like) of ink and the improvement of diaphragm properties has been assumed to make hardly any contribution to the modification of meniscus vibrations. However, if thin film piezoelectric elements are employed, the effect of the diaphragm properties (compliance and the like) on meniscus vibrations increases. When the compliance of diaphragm is large, the meniscus vibrations after ink ejection cannot be sufficiently attenuated. Conversely, when the compliance of diaphragm is small, the movement of diaphragm during ink ejection is small and ink cannot be sufficiently ejected.

Further, in the embodiment of Japanese Patent Laid-open Publication No. 6-340075, the thickness of piezoelectric elements is much larger than the thickness of diaphragm. Therefore, even if the vibrations of piezoelectric elements are controlled, the compliance of diaphragm is practically not changed. For this reason, a sufficient effect could not be demonstrated unless the timing was matched with the resonance frequency of piezoelectric elements, and the adjustment of timing was not simple.

Accordingly, it is an object of the present invention to provide a drive unit for a liquid ejection head, which makes it possible to suppress effectively the vibrations of meniscus with a simple configuration and device, and a liquid ejection apparatus using such a drive unit. It is another object of the present invention to provide a drive unit and a liquid ejection apparatus which make it possible to cause sufficient deflection of diaphragm when ink is ejected and rapidly attenuate the residual vibrations after ejection.

SUMMARY OF THE INVENTION

The present invention relates to a drive unit for a liquid ejection head in which contract of a pressure chamber and ejection of the liquid are caused by the application of a voltage to a piezoelectric body, to a drive method, and to a liquid ejection apparatus equipped with such a drive unit and liquid ejection head. The voltage applied to a piezoelectric thin film has an electric potential stable period in the course of returning from an electric potential when pressure chamber has contracted for the ejection of liquid to another electric potential prior to a drive for the next ejection. Providing the electric potential stable period suppresses deformation of piezoelectric thin film and vibrations of diaphragm. As a result, the compliance of piezoelectric thin film and diaphragm can be reduced and the natural vibration period Tc of pressure chamber can be decreased. Therefore, the meniscus vibrations can be effectively suppressed with a simple configuration and device.

Furthermore, in accordance with the present invention, a circuit connected to the piezoelectric thin film is disconnected within a specific period during damped meniscus vibrations after liquid ejection. Disconnecting the circuit connected to the piezoelectric thin film makes it possible to suppress reliably the electric potential changes on the piezoelectric thin film. Moreover, it is preferred that in the aforesaid drive unit, the disconnection of the circuit be intermittently conducted during damped meniscus vibrations.

Further, in accordance with the present invention, during damped meniscus vibrations after the liquid ejection, the natural period Tc of the pressure chamber is made shorter than the natural period during the liquid ejection. As a result, the natural period during damped meniscus vibrations after the liquid ejection can be shortened with respect to the natural period during liquid ejection. Then, the diaphragm can be sufficiently deflected during liquid ejection and the residual vibrations can be rapidly attenuated after the ejection.

An especially significant effect can be obtained when the polarization generated in a piezoelectric thin film during voltage application is no less than 0.25 $C/m^2$.

It is also preferred that the thickness of the piezoelectric thin film be 0.5 $\mu$m through 2 $\mu$m. A small thickness of the piezoelectric thin film can greatly change the compliance of the piezoelectric thin film and the diaphragm and can effectively suppress the residual vibrations. Furthermore, it is preferred that the time period from the pressure chamber contract to the beginning of the electric potential stable period be shorter than the natural period of the pressure chamber. As a result, the residual vibrations can be rapidly attenuated.

DESCRIPTION OF THE PREFERRED EMBODIMENT

The preferred embodiment of the present invention will be described below with reference to the drawings.

(Entire Configuration of Ink-jet Printer)

Figure 1:
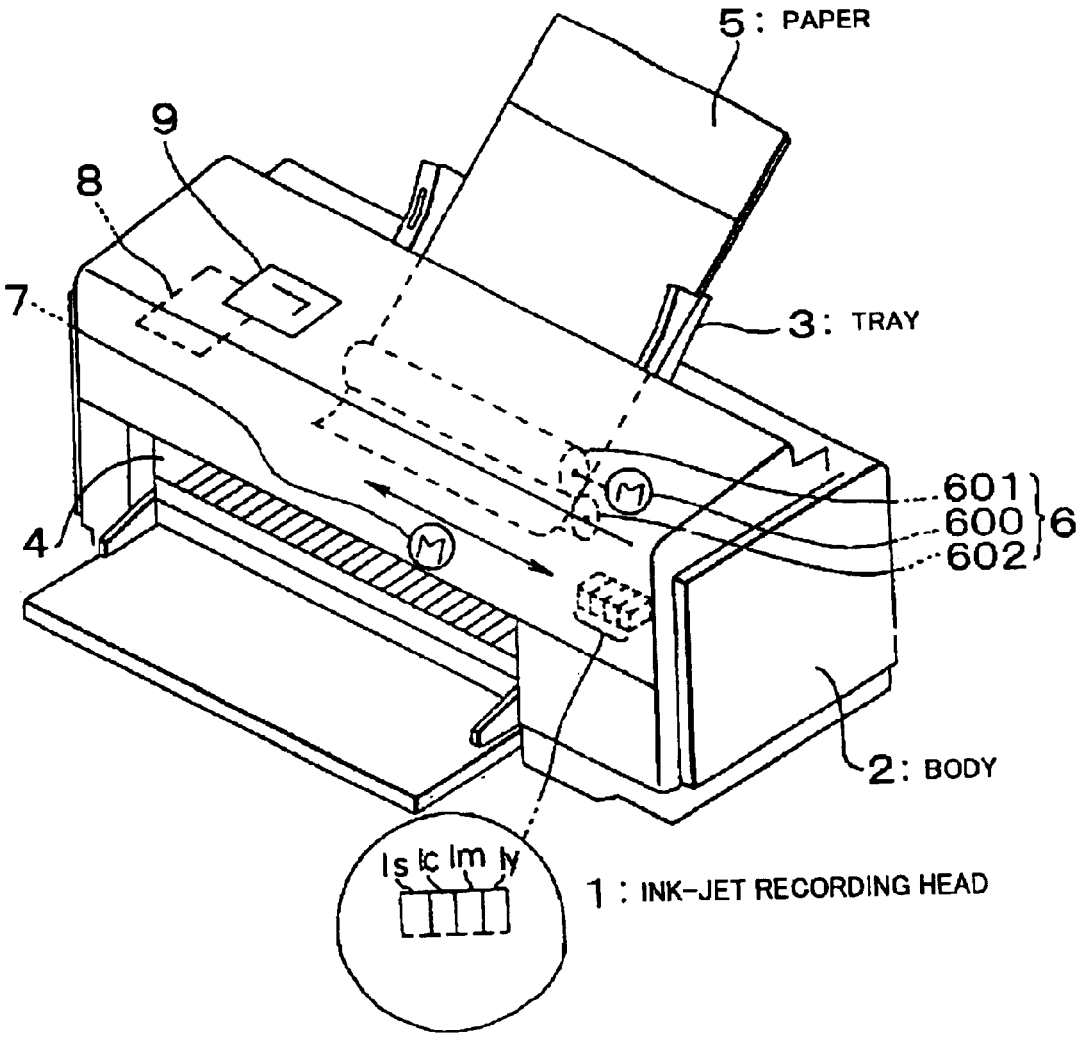
FIG. 1 is a perspective view illustrating the structure of the printer using the drive unit of the present embodiment.

FIG. 1 is a perspective view illustrating the configuration of a printer which is a liquid ejection apparatus using the drive unit of the present embodiment. In this printer, a tray 3, a release opening 4 and a control button 9 are provided in a body 2. Furthermore, an ink-jet recording head 1, which is a liquid ejection head, a feeding mechanism 6, and a control circuit 8 are provided inside the body 2. The control circuit 8 comprises the drive unit in accordance with the present invention.

The ink-jet recording head 1 comprises the below described piezoelectric elements. The ink-jet recording head 1 has a structure allowing for the ejection of ink from nozzles in response to ejection signals supplied from the control circuit 8.

The body 2 is a printer case. The feeding mechanism 6 is disposed in a position allowing for paper 5 to be supplied from the tray 3. The ink-jet recording head 1 is disposed so that printing can be conducted on paper 5. The tray 3 has a configuration allowing for the supply of paper 5 prior to printing to the feeding mechanism 6. The release opening 4 is an outlet opening for releasing paper 5 upon completion of printing.

The feeding mechanism 6 comprises a motor 600, rollers 601, 602, and other mechanical structure which is not shown in the figures. The motor 600 can rotate in response to drive signals supplied from the control circuit 8. The mechanical structure has a configuration allowing for the transmission of rotation force of motor 600 to rollers 601, 602. Rollers 601, 602 rotate when the rotation force of motor 600 is transmitted thereto, and the rotation thereof pulls in the paper 5 placed into the tray 3 and supplies the paper for printing with the head 1.

The control circuit 8 comprises CPU, ROM, RAM, interface circuit, and the like (not shown in the figure). The control circuit 8 can supply a drive signal to the feeding mechanism 6 or supply an ejection signal to the ink-jet recording head 1 in response to the printing information supplied from a computer via a connector (not shown in the figures). Furthermore, the control circuit 8 sets and resets the operation mode in response to the control signal from the control panel 9.

(Configuration of Ink-jet Recording Head)

Figure 2:
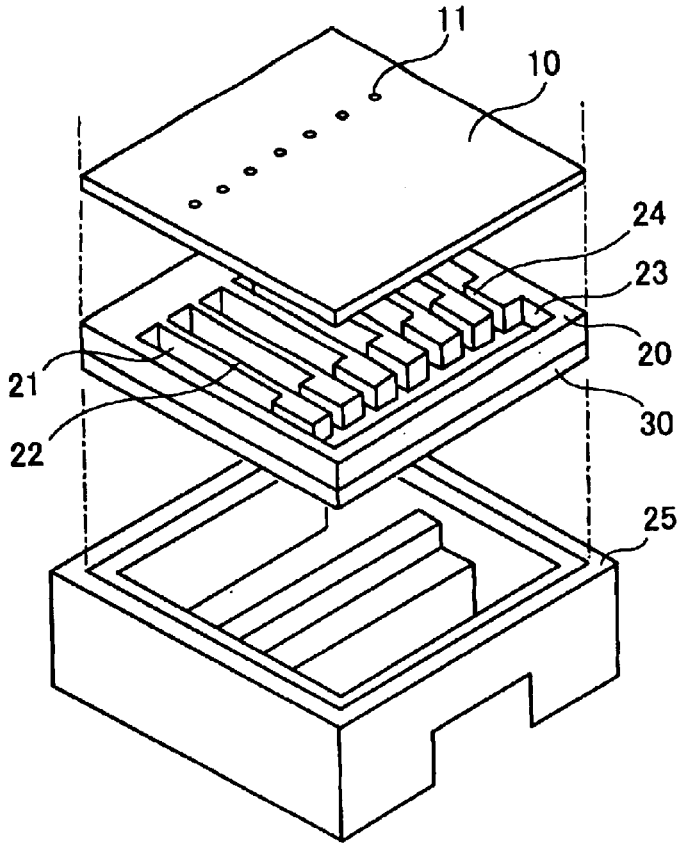
FIG. 2 illustrates the structure of the ink-jet recording head driven by the aforesaid drive unit.

FIG. 2 shows the structure of an ink-jet recording head driven by the drive unit. The ink-jet recording head 1, as shown in the figure, comprises a nozzle plate 10, a pressure chamber substrate 20, and a diaphragm 30. The head constitutes a piezo-jet head of an on-demand type.

The pressure chamber substrate 20 comprises pressure chambers (cavities) 21, side walls (partitions) 22, a reservoir 23, and supply openings 24. The pressure chambers 21 are the spaces for storing ink which is to be ejected, those spaces being formed by etching in a substrate from silicon or the like. Side walls 22 are formed so as to separate the pressure chambers 21 from each other. The reservoir 23 is a common passage for filling the pressure chambers 21 with ink. The supply openings 24 are formed so that ink can be introduced from the reservoir 23 into the pressure chambers 21.

The nozzle plate 10 is adhesively bonded to one surface of the pressure chamber substrate 20 so that the nozzle holes 11 thereof are located in positions corresponding to respective pressure chambers 21 provided in the pressure chamber substrate 20. The pressure chamber substrate 20 having the nozzle plate 10 adhesively bonded thereto is enclosed in a case 25 and constitutes the ink-jet recording head 1.

The diaphragm 30 is adhesively bonded to the other surface of the pressure chamber substrate 20. Piezoelectric elements (not shown in the figure) are provided on the diaphragm 30. An ink tank port (not shown in the figure) is provided in the diaphragm 30, and the ink stored in an ink tank that is not shown in the figures can be supplied into the pressure chamber substrate 20.

(Layered Structure)

Figure 3:
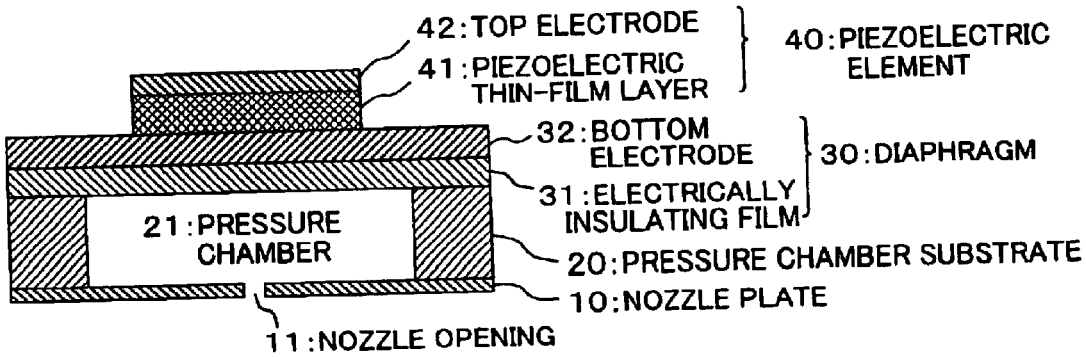
FIG. 3 is a cross-sectional view illustrating a more specific structure of the ink-jet recording head.

FIG. 3 is a cross-sectional view illustrating a more specific structure of the ink-jet recording head. This cross-sectional view is an expanded cross-sectional view of one pressure chamber and one piezoelectric element. As shown in the figure, the diaphragm 30 is formed by laminating an electrically insulating film 31 and a bottom electrode 32. A piezoelectric element 40 is formed by laminating a piezoelectric thin-film layer 41 and a top electrode 42 on the bottom electrode 32. The ink-jet recording head 1 is formed by arranging the piezoelectric element 40, the pressure chamber 21, and the nozzle opening 11 with a constant pitch in a row. The pitch between the nozzles can be changed appropriately according to the printing fineness. For example, the components can be arranged so as to obtain 400 dpi (dot per inch).

The electrically insulating film 31 is formed to a thickness of about 1 μm from a material which is not electrically conductive, for example, silicon dioxide. The electrically insulating film has a configuration such that it can be deformed by the deformation of the piezoelectric thin-film layer and the pressure inside the pressure chamber 21 can be increased instantaneously.

The bottom electrode 32 is one of the electrodes for applying a voltage to the piezoelectric thin-film layer and is formed to a thickness of about 0.2 μm from an electrically conductive material, for example, platinum and the like. The bottom electrode 32 is formed in the same region as the electrically insulating film 31 so as to function as a common electrode for a plurality of piezoelectric elements formed on the pressure chamber substrate 20. However, it can be also formed to the same size as the piezoelectric thin-film layer 41, that is, to the same shape as the top electrode.

The top electrode 42 is the other electrode for applying a voltage to the piezoelectric thin-film layer. The top electrode is formed to a thickness of about 0.1 μm from an electrically conductive material, for example, platinum or iridium.

The piezoelectric thin-film layer 41 is a crystal of a piezoelectric ceramic material, for example, such as lead zirconium titanate (PZT) having a perovskite structure. This layer is formed to the prescribed shape on the diaphragm 30. The thickness of the piezoelectric thin-film layer 41 is preferably no less than 0.5 μm to demonstrate sufficient liquid ejection ability and no more than 2 μm to suppress effectively the residual vibrations. For example, the thickness is about 1 μm.

(Printing Operation)

The printing operation will be explained below with respect to the above-described configuration of the ink-jet recording head 1. If a drive signal is output from the control circuit 8, the feeding mechanism 6 is actuated and the paper 5 is transported by the head 1 to a position in which printing can be conducted. When no ejection signal is supplied from the control circuit 8 and no voltage is applied between the bottom electrode 32 and the top electrode 42 of the piezoelectric element 40, no deformation appears in the piezoelectric thin-film layer 41. No pressure changes occur in the pressure chamber 21 provided with the piezoelectric element 40 to which no ejection signal has been supplied, and ink droplets are not ejected from the nozzle opening 11.

On the other hand, when an ejection signal is supplied from the control circuit 8 and a constant voltage is applied between the bottom electrode 32 and the top electrode 42 of the piezoelectric element 40, deformation appears in the piezoelectric thin-film layer 41. In the pressure chamber 21 provided with the piezoelectric element 40 to which the ejection signal has been supplied, the diaphragm 30 thereof deflects to a large degree. As a result, pressure inside the pressure chamber 21 rises instantaneously and ink droplets are ejected from the nozzle opening 11. Letters or figures can be printed by supplying the ejection signals separately to the piezoelectric elements in positions in the head where printing is to be conducted.

(Drive Unit)

Figure 4:
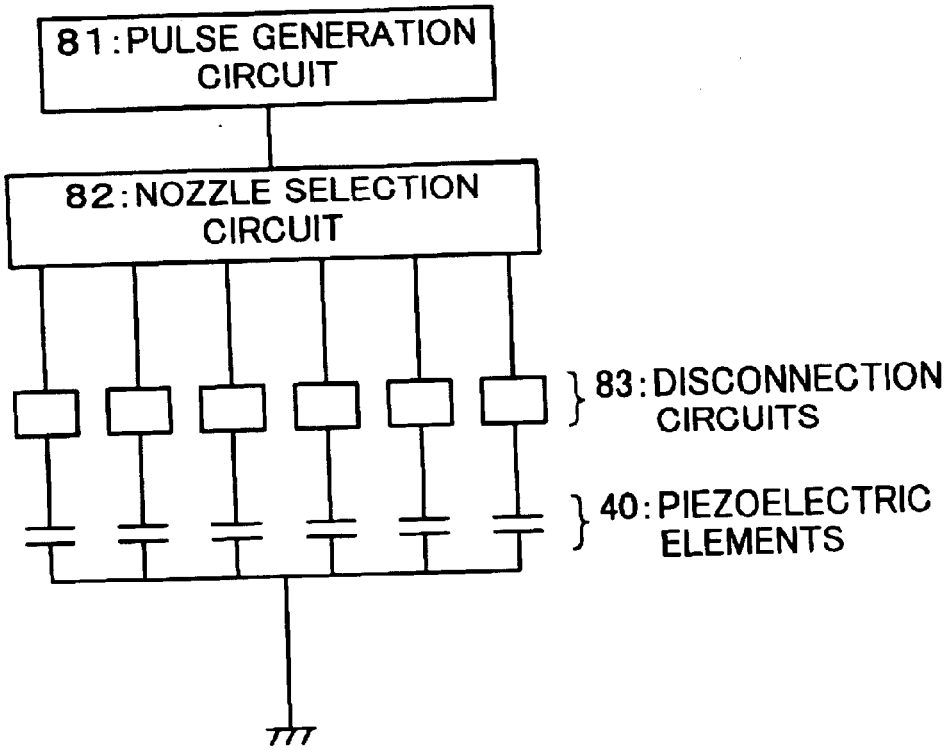
FIG. 4 shows a circuit of the drive unit of the present embodiment.

FIG. 4 illustrates a circuit diagram of the drive unit of the present embodiment. As shown in the figure, the piezoelectric thin-film elements 40 provided for each nozzle (each pressure chamber) of the ink-jet-head are represented as capacitors on the electric circuit. One electrode of each capacitor is made common and the common electrodes are grounded. The other electrode is connected to a drive unit selectively actuating each piezoelectric thin-film element 40.

The drive unit comprises a pulse generation circuit 81 for generating a drive pulse for driving the piezoelectric thin-film elements 40, a nozzle selection circuit 82 for selectively transmitting the drive pulse from the pulse generation circuit 81 to each piezoelectric thin-film element 40, and a switching circuit 83 that can intermittently switch the circuit connected to the piezoelectric thin-film elements 40.

One switching circuit 83 may be provided between the above-mentioned one electrode (common electrode) of the capacitor and the ground point, or respective switching circuits 82 may be provided between the above-mentioned other electrodes of capacitors and the nozzle selection circuit 82, as shown in the figure. The switching circuit 83, for example, comprises a high-frequency pulse generation circuit and a transistor with a high-speed response ability which receives this pulse and intermittently switches the circuits connected to the piezoelectric thin-film elements 40.

(Drive Signal)

Figure 5:
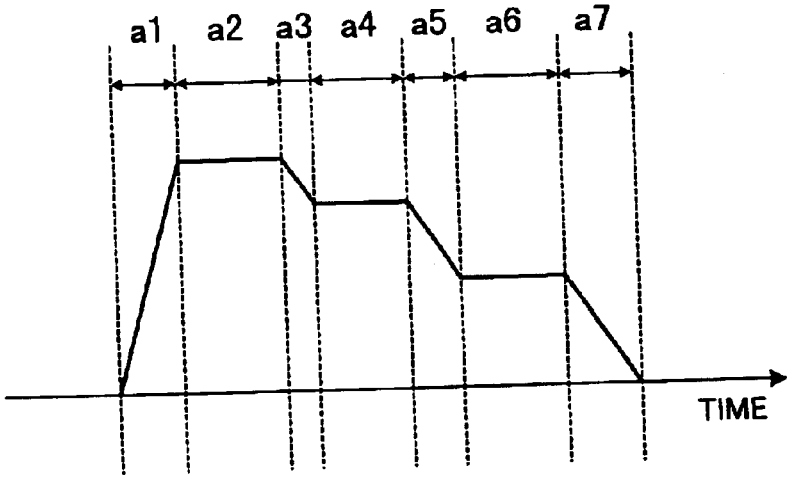
FIG. 5 is a pulse diagram showing an example of voltage pulses applied to the piezoelectric element by the drive unit of the present embodiment.
Figure 6:
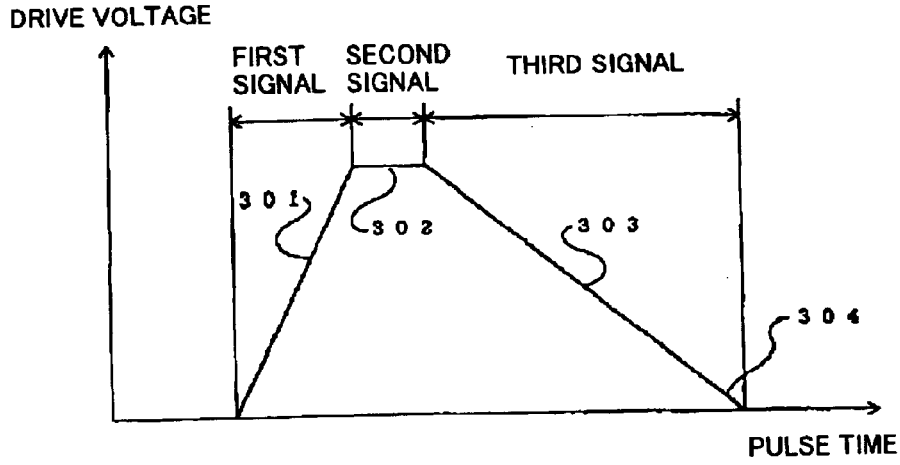
FIG. 6 is an example of the pulse diagram relating to a conventional drive unit.
Figure 7:
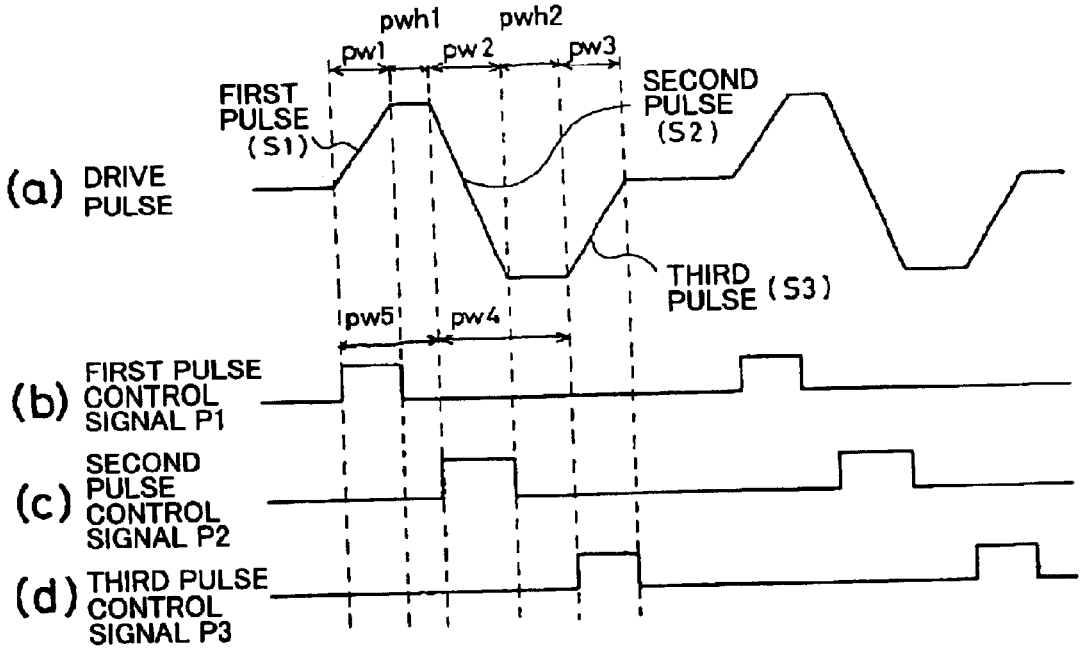
FIG. 7 is another example of the pulse diagram relating to a conventional drive unit.

FIG. 5 is a pulse diagram illustrating an example of the voltage pulse applied to the piezoelectric element by the drive unit of the present embodiment. The pulse shown in FIG. 5 comprises an electric potential increase period a1, an electric potential plateau period a2, electric potential decrease periods a3, a5, a7, and electric potential stable periods (discharge interruption periods) a4, a6. In the electric potential increase period al and electric potential plateau period a2, a voltage is applied to the piezoelectric body and the pressure chamber is caused to contract. As a result, ink is ejected from the nozzle. In the electric potential decrease period, the pressure chamber is expanded, the non-ejected ink is pulled into the nozzle, and ink is anew pulled in from the ink tank (not shown in the figures). At this time, the residual vibrations remain in the meniscus inside the nozzle. If the compliance of diaphragm is large at this time and the diaphragm intensively vibrates with a large period, the residual vibrations of the meniscus are difficult to attenuate. The following method is used in the present embodiment to decrease the compliance of diaphragm and enhance the attenuation of meniscus vibrations.

If the diaphragm vibrates, the piezoelectric thin film is deformed and, therefore, the polarization inside the piezoelectric material changes and an electric potential is generated (piezoelectric effect). In the present embodiment, providing one or more electric potential stable periods during damped vibrations of meniscus suppresses changes of the electric potential, that is, changes of the polarization. If changes of the polarization are suppressed, the deformation of piezoelectric body is suppressed. Thus, the compliance of the diaphragm provided with the piezoelectric thin film can be decreased.

If the compliance of diaphragm is decreased, the amplitude of damped vibrations of the meniscus is decreased. Furthermore, the meniscus vibration period (natural vibration period Tc of pressure chamber) is decreased. As a result, the attenuation of meniscus vibrations is accelerated and a high-frequency drive is made possible. Furthermore, in this embodiment, two electric potential stable periods are presented between the electric potential decrease periods a3, a5, a7 in FIG. 5. As shown in the figure, it is preferred than the electric potential be constant (flat) in the electric potential stable period.

In the time period in which the meniscus demonstrates residual vibrations, the diaphragm also vibrates. Therefore, the deformation of piezoelectric body generates changes in electric potential. If a circuit interruption period is provided during the damped meniscus vibrations after the ink ejection, changes in the electric potential of piezoelectric body and the deformation of piezoelectric body and the vibrations of diaphragm caused thereby are suppressed. As a result, the rigidity of piezoelectric body and diaphragm can be increased and the residual vibrations of meniscus can be effectively suppressed.

In particular, when a piezoelectric thin film is used as the piezoelectric body, the rigidity of the piezoelectric thin film is usually low and the film is easily deflected. For this reason, the compliance of the piezoelectric thin film greatly affects the resonance period of pressure chambers. Therefore, a significant effect can be obtained if the drive unit and the drive method of the present embodiment are applied to the ink-jet recording head using a piezoelectric thin film and the control is conducted so that the compliance of the piezoelectric thin film is decreased. Accordingly, it is preferred that the thickness of the piezoelectric thin film be no more than 2 $\mu$m. Furthermore, when a piezoelectric thin film is used such that the polarization generated in the piezoelectric thin film during voltage application is no less than 0.25 $C/m^2$, the compliance reduction effect caused by electric potential fluctuation suppression (polarization fluctuation suppression) of the piezoelectric body is high.

The time from the pressure chamber contract to the beginning of the electric potential stable period (this time is denoted by a3 in FIG. 5) is not required to be the same as the natural period of pressure chambers. Therefore, the drive pulse is comparatively easy to adjust. It is rather preferred that the time from the pressure chamber contract to the beginning of the electric potential stable period be shorter than the natural period of pressure chambers, for example, not more than 5 $\mu$s. As a result, the residual vibrations can be attenuated faster.

With the liquid ejection head drive unit and the drive method in accordance with the present invention, the meniscus vibrations can be effectively suppressed with a simple configuration and apparatus. Furthermore, the diaphragm can be sufficiently deflected during liquid ejection and the residual vibrations can be rapidly attenuated after the ejection.

What is claimed is:

1. A drive unit for a liquid ejection head in which ejection of liquid is caused by contract of pressure chamber that is caused by the application of a voltage to a piezoelectric thin film, wherein the natural period of said pressure chamber during damped meniscus vibrations after liquid ejection is made shorter than the natural period during the liquid ejection, wherein the polarization generated in said piezoelectric thin film during voltage applications is no less than 0.25 $C/m^2$.

2. A liquid ejection apparatus comprising a liquid ejection head provided with a piezoelectric thin film and a drive unit in which ejection of liquid is caused by contract of a pressure chamber that is caused by the application of a voltage to a piezoelectric thin film, wherein the natural period of said pressure chamber during damped meniscus vibrations after liquid ejection is made shorter than the natural period during the liquid ejection by said drive unit, wherein the polarization generated in said piezoelectric thin film during voltage application is no less than 0.25 $C/m^2$.

3. The liquid ejection apparatus according to claim 2, wherein the thickness of said piezoelectric thin film is 0.5 $\mu$m through 2 $\mu$m.

4. The liquid ejection apparatus according to claim 2, wherein the voltage applied to said piezoelectric thin film by said drive unit has an electric potential stable period in the course of returning from electric potential when said pressure chamber has contracted for the ejection of liquid to another electric potential prior to a drive for the next ejection, and wherein the time period from the ending of said pressure chamber contract to the beginning of said potential stable period is shorter than the natural period of said pressure chamber during the liquid ejection.

5. A drive unit for a liquid ejection head in which ejection of liquid is cause by contract of pressure chamber that is caused by the application of a voltage to a piezoelectric thin film, wherein the voltage applied to said piezoelectric thin film has an electric potential stable period in the course of returning from an electric potential when pressure chamber has contracted for the ejection of liquid to another electric potential prior to a drive for the next ejection, and wherein the polarization generated in said piezoelectric thin film during voltage application is no less than 0.25 $C/m^2$.

6. A liquid ejection apparatus comprising a liquid ejection head provided with a piezoelectric thin film and a drive in which ejection of liquid is caused by contract of a pressure chamber that is caused by the application of a voltage to a piezoelectric thin film, wherein the voltage applied to said piezoelectric thin film by said drive unit has an electric potential stable period in the course of returning from an electric potential when pressure chamber has contracted for the ejection of liquid to another electric potential prior to a drive for the next ejection, and wherein the polarization generated in said piezoelectric thin film during voltage application is no less than 0.25 $C/m^2$.

7. A liquid ejection apparatus comprising a liquid ejection head provided with a piezoelectric thin film and a drive unit in which ejection of liquid is caused by contract of a pressure chamber that is caused by the application of a voltage to a piezoelectric thin film.

wherein the voltage applied to said piezoelectric thin film by said drive unit has an electric potential stable period in the course of returning from an electric potential when pressure chamber has contracted for the ejection of liquid to another electric potential prior to a drive for the next ejection, and wherein the time period from the ending of said pressure chamber contract to the beginning of said potential stable period is shorter than the natural period of said pressure chamber during the liquid ejection, and wherein polarization generated in said piezoelectric thin film during voltage application in no less than 0.25 $C/m^2$.

* * * * *